United States Patent [19]

Schwartz

[11] 4,097,083

[45] Jun. 27, 1978

[54] ADJUSTABLE LIFTING THIMBLE

[75] Inventor: William H. Schwartz, Novato, Calif.

[73] Assignee: Roberton & Schwartz, Inc., San Francisco, Calif.

[21] Appl. No.: 806,741

[22] Filed: Jun. 15, 1977

[51] Int. Cl.[2] ..... B66C 1/12

[52] U.S. Cl. ..... 294/78 A

[58] Field of Search ..... 294/1 R, 74, 78 R, 78 A; 24/115 R, 115 G, 132 R, 132 AA; 188/65.1, 65.2; 254/156, 167, 188, 191, 192

[56] References Cited

U.S. PATENT DOCUMENTS

| | | | |
|---|---|---|---|
| 564,012 | 7/1896 | Fraser | 188/65.1 |
| 1,673,960 | 6/1928 | Watson | 254/191 |
| 2,658,720 | 11/1953 | Coffing | 254/167 |
| 2,838,336 | 6/1958 | Archer | 294/78 R |
| 2,919,949 | 1/1960 | Caldwell | 294/78 A X |
| 2,942,315 | 6/1960 | Johnson | 294/74 X |
| 2,955,560 | 10/1960 | Howington et al. | 294/78 R X |

FOREIGN PATENT DOCUMENTS

| | | | |
|---|---|---|---|
| 113,240 | 3/1969 | Denmark | 294/78 A |
| 955,824 | 4/1964 | United Kingdom | 294/78 A |

*Primary Examiner*—Johnny D. Cherry
*Attorney, Agent, or Firm*—Phillips, Moore, Weissenberger, Lempio & Majestic

[57] ABSTRACT

An adjustable lifting thimble for lifting a load, including a center plate, a circular plate connected to one side of the center plate and having a groove for slidably receiving a wire rope between the ends thereof, another circular plate connected to the other side of the center plate and having a groove for slidably receiving another rope between the ends thereof, and a locking mechanism, pivotally connected to the center plate and slidably receiving the ropes, for automatically pivoting to prevent sliding of the ropes when the load is lifted.

11 Claims, 4 Drawing Figures

ADJUSTABLE LIFTING THIMBLE

BACKGROUND OF THE INVENTION

The invention relates to a thimble for lifting a load and, more particularly, to a thimble which is relatively shiftable along a wire rope but adapted to lock automatically the rope to prevent tilting of the load when lifted.

Load lifting thimbles or slings are well known in the art for lifting loads at a desired attitude and maintaining this attitude while the load is suspended. Typically, a wire rope is slung about the thimble and its ends attached to the load to be lifted. A crane hook is then placed through the eye of the thimble which is then moved along the rope to a position estimated by the crane operator to be over the center of gravity of the load. The load is then raised, and if it does not rise in the desired attitude, such as a level attitude, it is lowered to re-position the thimble more precisely over the center of gravity. The load is then raised again, but presumably this time over the center of gravity so that the load is lifted at the desired attitude.

When the load is lifted, it is important that the wire rope not slip relative to the thimble; otherwise, this will in effect re-position the thimble away from the center of gravity of the load causing an undesirable shift in attitude. To avoid this problem, typically the prior thimbles have a V-shaped groove about which the rope is slung. When a load is lifted, the rope is wedged more tightly into the groove to frictionally lock or brake the rope to prevent slippage. However, even with this wedging action a load suspended from the ends of the rope can overcome these frictional forces should the contents of the load shift causing a change in the center of gravity.

Furthermore, with the wire rope wedged into the V-shaped grooves, after the load is removed from the rope, it would be difficult to re-position the thimble for hoisting a new load. Consequently, prior thimbles usually have some way of releasing the rope from its wedged position within the groove. This involves utilizing an additional mechanism on the thimble which applies an upward force on the rope to move it upwardly from the wedged position to enable the rope to slide more freely.

SUMMARY OF THE INVENTION

It is an object of the present invention to provide a novel load lifting thimble which is relatively shiftable along the length of a rope and which automatically prevents slippage when a load is lifted.

It is another object of the present invention to provide a thimble which more positively locks the rope in position when lifting a load to prevent slippage.

Another object of the present invention is to provide a mechanism for locking the rope without additional means for releasing the rope from its locked position.

A still further object of the present invention is to provide a thimble which is more simple and less costly than prior thimbles.

These and other objects of the present invention are obtained through the use of a thimble including a frame relatively shiftable along a rope and having a means for supporting the rope, and means, pivotally mounted to the frame, for automatically pivoting when a load is lifted to contact the rope to prevent the relative shifting. The pivoting means includes a means, having a groove shaped to conform to the circumference of the rope, for pressing on the upper rope surface, and means, defining a passage, for receiving the rope therethrough, the receiving means having a surface on which the rope bears when a load is lifted to pivot the pivoting means in one direction and lower the pressing means onto the rope. When the load is set down, the rope acts against the pressing means to pivot the pivoting means in the opposite direction and thereby release the rope.

DETAILED DESCRIPTION OF THE DRAWINGS

Figure 3:
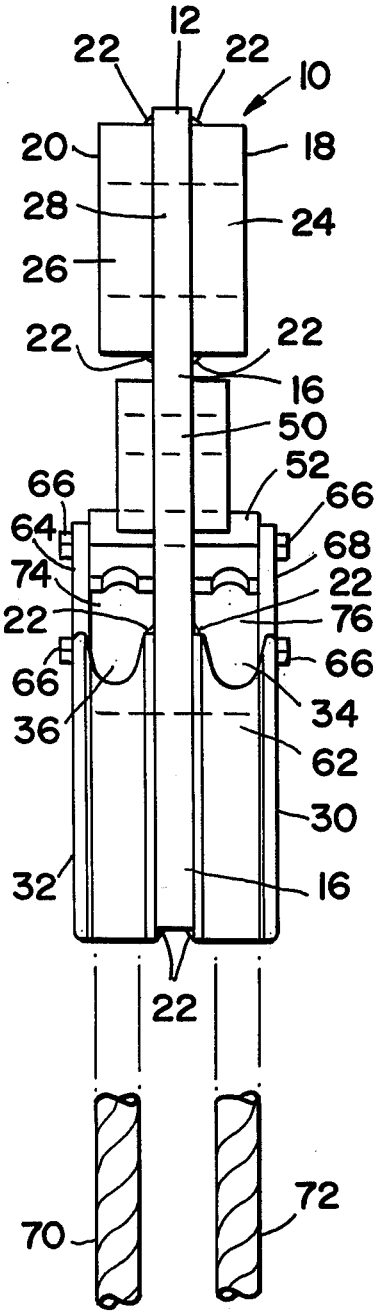
FIG. 3 is an end elevation of the thimble of FIG. 1.
Figure 1:
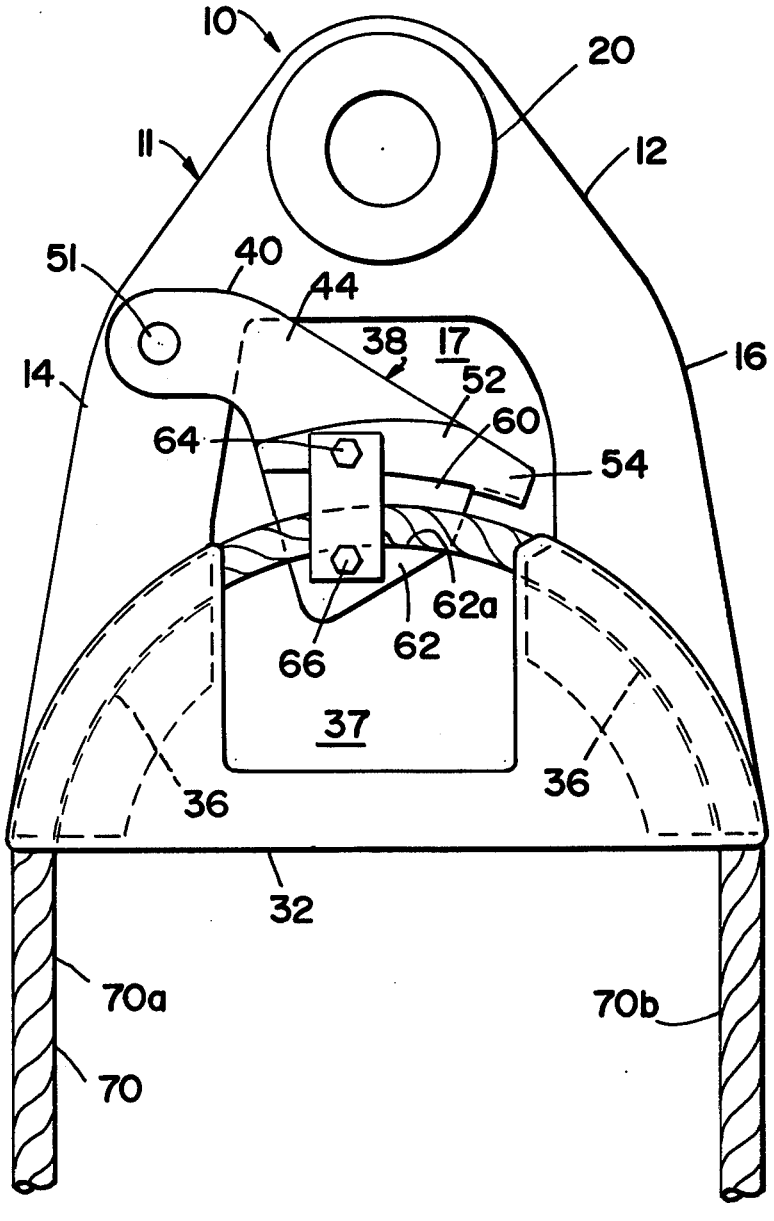
FIG. 1 is a front elevation view of a thimble of the present invention with no load being carried thereby.

In FIGS. 1 and 3 there is shown a thimble 10 for lifting loads (not shown). The thimble 10 includes a frame 11 having center plate 12 which is of inverted U-shape having two depending legs 14 and 16 with a gap 17 therebetween. Rings 18 and 20 are connected on either side of center plate 12 by welds 22 and have holes 24 and 26, respectively, aligned with a hole 28 in the plate 12. These rings 18 and 20 space or elongate the hole 28 with holes 24 and 26 so that a shackle (not shown) may extend through these holes and be connected to a crane for lifting the thimble 10 without sliding movement of the thimble along the shackle.

A semi-circular cheek plate 30 is attached to the lower part of legs 14 and 16 on one side of plate 12 by similar welds 22. Another cheek plate 32, similar to plate 30, is attached to the other side of plate 12 by welds 22 at the lower portion of legs 14 and 16. Each of the cheek plates 30 and 32 has a respective U-shaped groove 34 and 36 extending about the periphery of these plates. As shown in FIG. 1, plates 30 and 32 have an aligned respective cut-out 37, thereby making the U-shaped grooves 34 and 36 discontinuous about the periphery of their respective plates 30 and 32.

Figure 4:
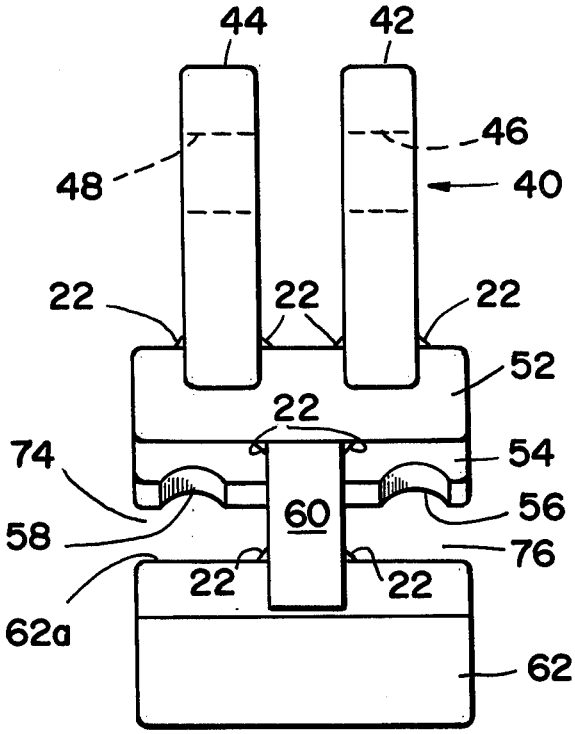
FIG. 4 is an end view of a locking mechanism of the thimble of FIG. 1.

A rope locking mechanism 38 shown in FIG. 1 and in more detail in FIG. 4 has a bifurcated end 40 including two spaced apart plates 42 and 44 with respective aligned holes 46 and 48. Plates 42 and 44 are positioned on either side of leg 14 of center plate 12 and have their holes 46 and 48 aligned with a hole 50 (see FIG. 3) in the leg 14. A pivot pin 51 extends through holes 46, 48 and 50.

Figure 2:
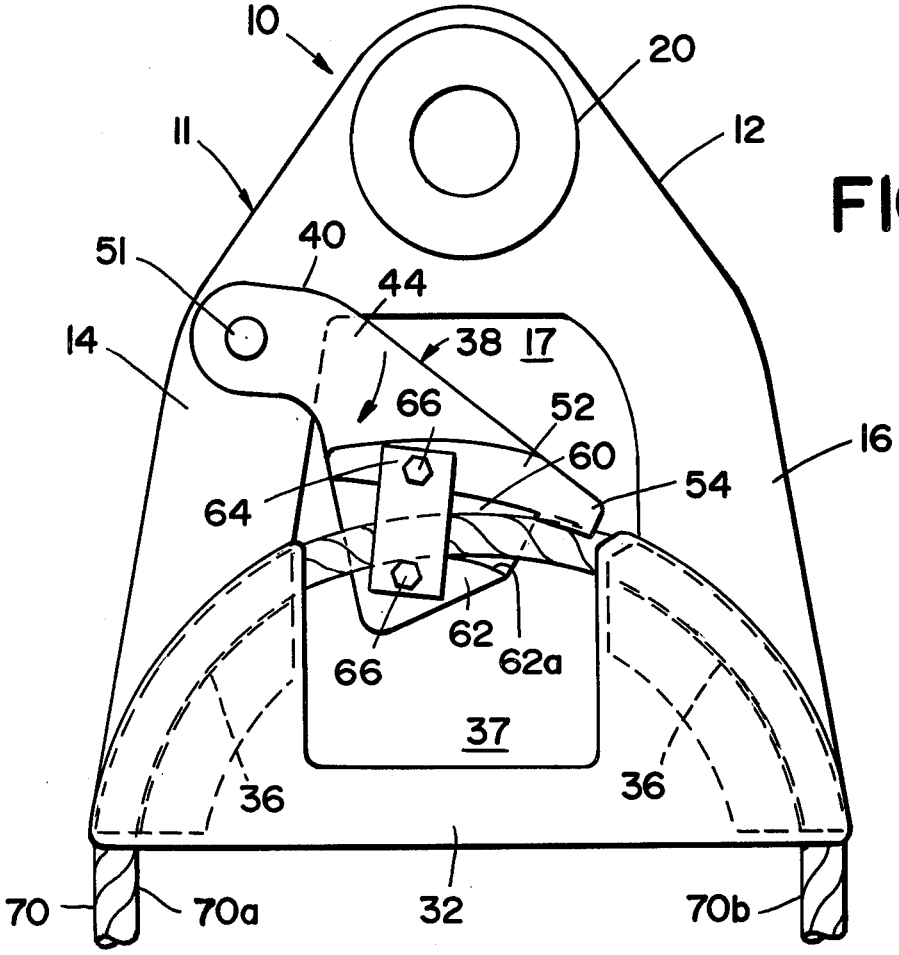
FIG. 2 is a front elevation of the thimble having a load carried thereby.

Pivot mechanism 38 also includes a block or plate 52 interconnecting the lower ends of plates 42 and 44 which are welded by welds 22 to this plate. Plate 52 has at one extended end a heel 54 having two U-shaped grooves 56 and 58. A center plate 60 is welded by welds 22 at its upper end to block 52 and at its lower end to another block or plate 62. As shown in FIGS. 1 and 2, a side plate 64 is bolted to one side of plates 52 and 62 by bolts 66 while another side plate 68 is bolted to the other side of plates 52 and 62 by bolts 66.

Two wire ropes 70 and 72 have standard hooks (not shown) at their lower ends which can be coupled to a load to lift the load. Wire rope 70 is slung through the part of groove 36 adjacent leg 14, then through a channel or passage 74 formed by plate 52, center plate 60, plate 62 and side plate 64 which retains the rope within this channel, and then through the part of groove 36 adjacent leg 16. Wire rope 72 extends through the part of groove 34 adjacent the other side of leg 14, then through another channel 76 provided by plate 52, center plate 60, plate 62 and side plate 68 which retains the rope within this channel, and then through the part of groove 34 adjacent leg 16. Grooves 34 and 36 are shaped to enable the wire ropes 70 and 72 to slide relatively easily relative to the thimble 10; that is, these ropes 70 and 72 are not tightly wedge fit into the grooves 34 and 36 whether or not a load is being lifted. Also, these ropes 70 and 72 can slide along the top surface 62*a* of plate 62 within respective passages 74 and 76. Each rope such as rope 70 shown in FIG. 1 may be considered to have two legs 70*a* and 70*b* which will vary in length depending on the position of the thimble 10 along the ropes.

In operation, FIG. 1 illustrates the thimble 10 without a load being lifted. In this position, pivot mechanism 38 has the heel 54 raised above the ropes 70 and 72 and these ropes maintain a substantially circular configuration across the respective gaps 37 and within channels 74 and 76, while resting within the grooves 34 and 36. To lift a load, a shackle (not shown) coupled to a lifting crane (not shown) is placed through the aligned holes 24, 26 and 28 and hooks (not shown) at the lower ends of ropes 70 and 72 are connected to the load. Then, as shown in FIG. 2, as the load is lifted the wire ropes 70 and 72 tend to flatten across the respective gaps 37. This flattening action causes the ropes 70 and 72 to press downwardly or bear forcibly on the top surface 62*a* of block 62 which results in the mechanism 38 being pivoted about pin 51 in a clockwise direction. The heel 54 will thus move downwardly bringing grooves 56 and 58, which are shaped to conform to the ropes 70 and 72, into pressing contact with the respective ropes 72 and 70 within the respective gaps 37. Because of this pressing action by heel 54, the ropes 70 and 72 will be prevented from slipping within grooves 34 and 36 and thereby locked in position to prevent unwanted tilting of the load. It will be appreciated that the heavier the load, the greater will be the tendency for the wire ropes 70 and 72 to flatten and, thus, the tighter will heel 54 press on the ropes 70 and 72. When the load is then set down, the ropes 70 and 72 will tend to reassume their circular shape as shown in FIG. 1. Consequently, these ropes 70 and 72 will provide an upward force within grooves 56 and 58 to pivot the mechanism 38 in a counterclockwise direction about pivot 52, thereby unlocking the ropes, for repositioning on another load.

As can be appreciated from the above discussion, the thimble 10, in addition to locking the ropes 70 and 72 in a desired position with mechanism 38, can also be moved along the ropes to position the thimble above a desired part of the load. For example, the load may be unbalanced with its center of gravity unknown and if the thimble 10 is positioned away from this center of gravity, the load may be lifted with an undesirable tilt. To avoid this, the crane operator will move the thimble 10 along the ropes 70 and 72 to position it over the estimated center of gravity. If the load then does not rise in the desired attitude, the load is lowered and the thimble 10 is slid along the ropes to a position over the center of gravity. When the load is then raised, it will be at the desired attitude with the ropes locked in position to the thimble 10 by heel 54.

To give an indication of one size of thimble 10, the full spread of center plate 12 from the outer side of leg 14 to the outer side of leg 16, as viewed in FIG. 1, can be about 20 inches (about 50.8 centimeters), while the height of center plate 12 can be about 22 inches (about 56 centimeters). The other parts of thimble 10 would be sized proportionately. The entire weight of this size thimble 10, excluding ropes 70 and 72, would be about 187 pounds (about 84.15 kilograms) and could support about a 70,000 pound load (about 31,500 kilograms).

While the invention has been described having a thimble 10 with two ropes 70 and 72, it will be appreciated that the principles of this invention will apply to a thimble having a single rope such as rope 70, a single cheek plate 32, and a single channel or passage 74 or 76.

While the invention has been particularly described with reference to a preferred embodiment thereof, it will be understood by those skilled in the art that changes in form and details may be made therein without departing from the spirit and scope of the invention.

What is claimed is:

1. A thimble for lifting a load attached to both ends of a rope, comprising:

a. a frame having means for supporting the rope between the ends thereof, said frame being relatively shiftable along the rope; and b. means, pivotally mounted to said frame for automatically pivoting when a load is lifted to forceably contact the rope to prevent the relative shifting thereof, said pivoting means including means having a first groove shaped to conform to the circumference of the rope for pressing on the upper rope surface and means defining a passage for receiving the rope therethrough, said receiving means having a surface on which the rope forceably bears downwardly when a load is lifted to pivot said pivoting means and lower said pressing means onto the rope within said first groove.

2. A thimble according to claim 1 wherein said means for supporting comprises a circular plate having a second groove for slidably receiving the rope, said plate having a cut-out making said second groove discontinuous and in which the rope tends to flatten when a load is lifted.

3. A thimble according to claim 2 wherein said pivoting means is connected to said frame so that said pressing means presses on the rope within said cut-out.

4. A thimble according to claim 3 wherein said frame comprises an inverted U-shaped plate having first and second legs having a gap therebetween, said circular plate being connected to the lower portion of said first and second legs so that said cutout is aligned with said gap, said pivoting means having a pivot pin extending through the upper portion of said first leg, and said receiving means and said pressing means extending over said cut-out.

5. A thimble according to claim 2 wherein said pivoting means pivots in response to upward movement of the rope within said first groove when a load is set down to enable the relative shifting of said frame.

6. A load lifting thimble, comprising:

(a) first and second ropes for coupling to a load;

(b) a first center plate;

(c) a second circular plate connected to one side of said first plate and having a first groove for slidably receiving said first rope between the ends thereof;

(d) a third circular plate connected to the other side of said first plate and having a second groove for slidably receiving said second rope between the ends thereof; and (e) means, pivotally connected at one end to said center plate, for preventing sliding of said first and second ropes when the load is lifted, including means defining first and second passages for receiving therethrough said first and second ropes, respectively, and means for contacting the upper surfaces of said first and second ropes, respectively, said preventing means being pivotable by said ropes when the load is lifted to bring said contacting means into forcible contact with said ropes and being pivotable by said ropes when the load is lowered to remove said forcible contact and permit said sliding.

7. A load lifting thimble according to claim 6 wherein said first plate is of inverted U-shape having first and second legs, and said second plate and said third plate have respective cut-outs making said first groove and said second groove discontinuous, respectively, said first and second ropes extending over said respective cut-outs.

8. A load lifting thimble according to claim 7 wherein said preventing means comprises:

(a) a fourth plate on one side of said first leg;
(b) a fifth plate on the other side of said first leg; and
(c) a pivot pin extending through said fourth plate, said first leg and said fifth plate.

9. A load lifting thimble according to claim 8 wherein said first and second passage defining means comprises a sixth plate movable into said cut-outs and having a surface against which said first and second ropes act to pivot said contacting means downwardly into contact with said ropes.

10. A load lifting thimble according to claim 9 wherein said contacting means comprises means interconnecting said sixth plate and said fourth and fifth plates and having third and fourth grooves for receiving said first and second ropes, respectively, in said cut-outs when the load is lifted.

11. A load lifting thimble according to claim 10 wherein said first plate has a hole at an upper end thereof, and further comprising a first ring and a second ring connected on respective sides of said first plate and aligned with said hole to receive a load lifting shackle.

* * * * *